United States Patent [19]

Ambrose

[11] Patent Number: 4,852,177

[45] Date of Patent: Jul. 25, 1989

[54] HIGH FIDELITY EARPHONE AND HEARING AID

[75] Inventor: Stephen D. Ambrose, Hollywood, Calif.

[73] Assignee: SenseSonics, Inc., Los Angeles, Calif.

[21] Appl. No.: 901,203

[22] Filed: Aug. 28, 1986

[51] Int. Cl.[4] ..... H04R 1/10; H04R 1/38

[52] U.S. Cl. ..... 381/154; 181/135; 381/68.6; 381/69; 381/153; 381/158; 381/187

[58] Field of Search ..... 381/154, 68, 68.1–68.4, 381/69, 194, 183, 187, 158, 159, 153, 154; 181/135

[56] References Cited

U.S. PATENT DOCUMENTS

| | | | |
|---|---|---|---|
| 2,312,534 | 3/1943 | Fiene | 181/135 |
| 2,363,175 | 11/1944 | Grossman | 381/68.6 |
| 3,183,312 | 5/1965 | Salomon et al. | 381/68.3 |
| 3,408,461 | 10/1968 | Langford | 381/68.6 |
| 3,470,328 | 9/1969 | Daniels | 381/68.6 |
| 3,702,123 | 11/1972 | Macken et al. | 381/68 |
| 3,763,333 | 10/1973 | Lichowsky | 381/68 |
| 3,836,732 | 9/1974 | Johanson et al. | 381/68.1 |
| 3,909,556 | 9/1975 | Johanson | 381/68.1 |
| 3,946,168 | 3/1976 | Preves | 381/68.1 |
| 3,975,599 | 8/1976 | Johanson | 381/68.1 |
| 4,069,400 | 1/1978 | Johanson et al. | 381/69 |
| 4,142,072 | 2/1979 | Berland | 381/68.1 |
| 4,375,016 | 2/1983 | Harada | 381/68.6 |
| 4,407,389 | 10/1983 | Johnson | 381/69 |
| 4,442,917 | 4/1984 | Johnson | 181/135 |
| 4,532,649 | 7/1985 | Bellafiore | 381/68.4 |
| 4,548,082 | 10/1985 | Engebretson et al. | 381/68.6 |
| 4,629,833 | 12/1986 | Kern et al. | 381/68.2 |

FOREIGN PATENT DOCUMENTS

| | | | |
|---|---|---|---|
| 2512343 | 10/1976 | Fed. Rep. of Germany | 381/68.6 |

OTHER PUBLICATIONS

Macrae, John, "Venting Without Feedback-Further Development of the High Cut Cavity Vent", *Hearing Instruments,* vol. 33, Apr. 1982, pp. 12 and 30.

*Primary Examiner*—Jin F. Ng
*Assistant Examiner*—Danita R. Byrd
*Attorney, Agent, or Firm*—L. Lee Humphries

[57] ABSTRACT

A high fidelity earphone or hearing aid utilizes an acoustic path from a location near where the sound is delivered to the ear, to a location near the backside of the sound-producing diaphragm. A vent to the atmosphere from a location near the backside of the sound-producing diaphragm is also taught. A microphone on the earphone makes it safe to listen to the radio or a tape player in public, because of the capability of hearing outside sounds.

36 Claims, 3 Drawing Sheets

HIGH FIDELITY EARPHONE AND HEARING AID

BACKGROUND OF THE INVENTION

This invention relates to an earphone or a hearing aid which provides greater fidelity in the reproduction of music and other sound. As used herein, the word "earphone" is intended to include, within its meaning, the similar part of a "hearing aid". The device of the invention may be used by persons with normal hearing, desiring greater fidelity sound, particularly music; and it may also be used by those who have hearing impairment and need a hearing aid in order to hear.

Some of the effects desired to be achieved in presentation of sound to the auditory canal of the ear, or to any location, are, little distortion, little or no undesirable, acoustic or other feedback, and, normally, linear amplification. Often, an earphone or a hearing aid will provide sound with a hollowness, as if being heard through a tube. Other systems do not reproduce the low or the high frequencies adequately. In many devices of the prior art, distortion is found to occur.

When the pressure inside the auditory canal was vented to the atmosphere (the ambient air, or air outside the canal or outside the ear), it substantially improved the performance of hearing aids but also introduced some problems. The sound from the vent path was often picked up by the input microphone and this caused excessive feedback which led to squealing or ringing. Various dampers in the sound delivery paths and in the vent paths reduce the sensitivity of hearing aids to feedback and allow compromise and adjustment to the specific needs of the user.

SUMMARY OF THE INVENTION

In the device of the invention, a second acoustic path is provided in addition to the main acoustic path. Such second acoustic path runs from inside the ear canal at a location relatively near where the sound (air pressure variation) from the main acoustic path is delivered, to a location at the back side of the sound-producing diaphragm. Thus, pressure in the ear canal is relieved, but in a way differently than those devices which relieve pressure in the ear canal by venting to the atmosphere. The difference in the device of the invention is that such vented pressure is not lost, but is returned to the system at a correct location, increasing its efficiency and, also, its fidelity.

In the device of the invention, it is believed that the second acoustic path not only provides for relief of the pressure within the ear canal at a location near where the sound is heard but also provides for transmission of some sound to the ear. The air pressure is transmitted both ways in the second acoustic path. By such structure, the range of frequency response is substantially improved.

Suitable dampers may still be utilized, in one or both paths, to obtain desired frequency response and to customize the hearing aid to the particular difficulty of the hearer. In this regard, a system utilizing a microphone and amplification may additionally use equalization to arrive at the optimum frequency response for specific use or user. Venting to the ambient air, by various conduits disclosed herein, may additionally be utilized in some systems. Still other techniques known to those skilled in the art may be combined with the instant invention to achieve an improved hearing aid or earphone.

The device of the invention may be used as an improved earphone, without being sealed in the ear canal as is customary with a hearing aid. Such an embodiment may be used with transistor radios and tape players and the like. The fidelity is excellent and provides improved quality in the sound. It also may be used as an earphone which is sealed in the ear by a soft rubber or plastic which is resilient and fits the ear canal. Also, it may be combined with a customized earmold which is specially fitted to the user.

The device of the invention may also be used as a hearing aid which has a customized earmold as well as customized frequency response. Such customizing of frequency response may occur as a result of testing the user and adapting the amplification, frequency response, damping or other aspect.

It is therefore, an object of this invention to provide an improved earphone or hearing aid.

Another object of this invention is to provide an earphone which has a wide range of frequency response.

Still another object of this invention is to provide an earphone which is improved in efficiency.

A further object of this invention is to provide an earphone which may be customized to the specific needs of a user.

A still further object of this invention is to provide an earphone which has improved fidelity and may provide sound either inside or outside the ear canal.

Another object of this invention is to provide an earphone which may be used with various features of other hearing aids or earphones.

Still other objects and features will become apparent to those skilled in the art from the following drawings and description.

DESCRIPTION

Figure 1:
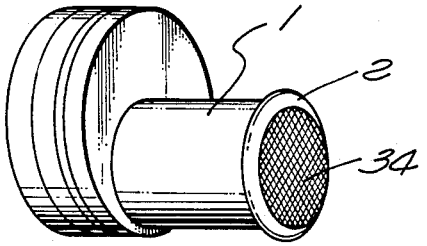
FIG. 1 is a view of one embodiment of the earphone.

The device of the invention is illustrated in FIG. 1, which shows an eartip 1 which is intended to fit into a person's ear canal. The end of eartip 1 may be open or covered by an acoustic mesh, such as that shown at 34 foam rubber or a gauze or other material. Rib 2 aids in sealing eartip 1 within the ear canal, for improved sound reproduction. A number of component parts then complete the earphone, as may be understood by reference to FIG. 2.

It is to be understood that, in some cases, eartip 1 may be very short and not enter into the ear canal and, in other cases, may enter only very slightly. Optimally, it would enter the ear canal about half or two-thirds of the way to the eardrum.

Figure 2:
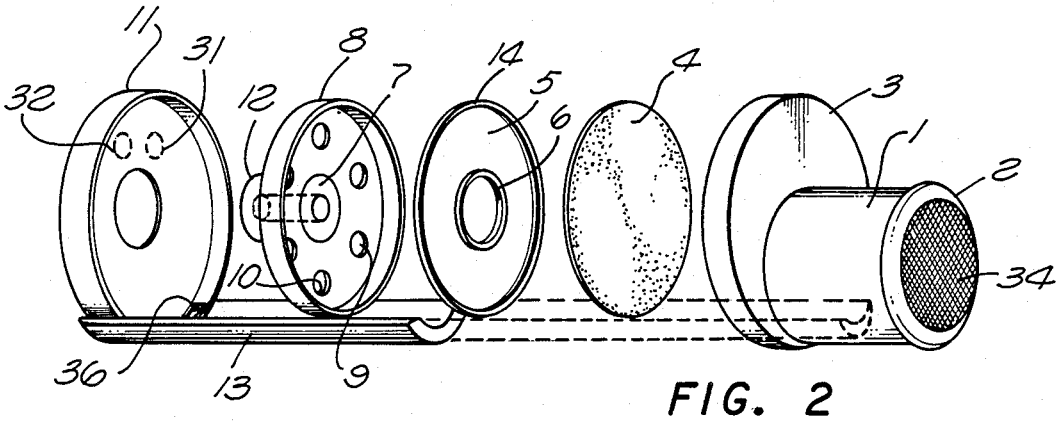
FIG. 2 is an exploded view showing the main elements of an embodiment of the earphone, particularly the second sound path from inside the ear to a manifold at the back side of the diaphragm.

In FIG. 2, a first housing 3 is adapted to receive an air baffle 4 which helps to form an air chamber next to diaphragm 5. A coil 6 on the diaghragm receives electrical signals to drive the diaphragm 5, which may be made of Mylar or other film material, mounted in a ring 14. The diaphragm is driven to vibrate by the coil 6. The ring mounts in or against housing 8, depending how much of a chamber is desired. Such diaghragm, of course, then causes vibrations (compression and expansion) in the air, which is transmitted through the conduit through eartip 1 and is delivered to the ear near the end of the eartip 1. Coil 6 interacts electomagnetically with permanent magnet 7 disposed in housing 8 which has holes therethrough such as 9 and 10. In the preferred embodiment, such holes are covered with a foam rubber, a gauze, or other acoustic damping material. Housing 11, together with housing 8, provide a manifold comprised of a chamber whose walls are formed by the housings. As may be seen by reference to FIG. 2, housing 8 provides a front wall for the manifold chamber and housing 11 provides a rear wall. The holes of housing 8 provide inlets and outlets to such manifold chamber. A vent to the atmosphere is provided by vent tube 12.

Figure 3:
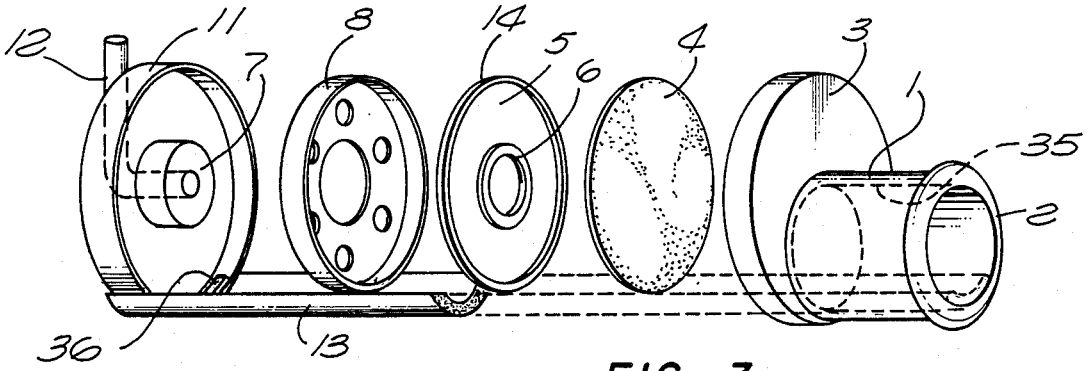
FIG. 3 is a modified version of the earphone, in which a vent to the atmosphere runs from a central location at the back side of the diaphragm.

The concept of the invention is illustrated in FIG. 2 wherein a second sound path 13 (or conduit 13) runs from inside the ear canal to the manifold chamber between housings 11 and 8. Sound path 13 is shown as terminating inside eartip 1. It may also terminate at the end of the eartip, as shown in FIG. 3. This is preferred. It may even extend farther, but as a practical matter, it is best terminated at the eartip opening. In those cases wherein eartip 1 is very short and does not enter the ear canal or hardly enters the ear canal at all, sound path 13 may extend into the ear beyond the eartip, may end at the end of the eartip or end within the eartip. Therefore, the second sound path 13 terminates in proximity to the end of the eartip 1, through which the first sound path runs. Thus, the two sound paths terminate in proximity to each other, as may be seen in FIG. 3 and other FIGS. in the drawings. It is noted that an acoustic mesh 34 covers the end of eartip 1 in FIG. 2 while in FIG. 3 the sound path having inner wall 35, running through eartip 1, is open at the end. The other end of sound path 13 has an opening 36 into the manifold chamber formed by housing 11 and 8.

In one view, the sound path 13 provides a return path for venting the compressions and rarefactions (of air provided to the ear) to the back side of the diapghragm. In a second view, sound path 13 provides a second path to the ear with compressions and rarefactions from the back side of the diaphragm. These are 180 degrees out of phase with compressions and rarefactions provided to the ear from the front of the diaphragm. In any event, it can be seen how a closed loop of sound is obtained. Whenever air is pushed by the front of the diaphragm, air is pulled by the back side of the diaphragm, subject to any delay or resistance caused by damping in the sound channels. Likewise, whenever air is pushed by the back side of the diaphragm, air is pulled by the front side of the diaphragm.

In FIG. 3 is shown magnet 7 being mounted on housing 11, rather than housing 8, as in FIG. 2. Such magnet and coil 6 still interact, of course, to drive diaphragm 5. Atmosphere vent 12 runs through the center of magnet 7 and then runs upwardly to a remote location. This allows the exhaust from tube 12 to be dissipated with the least effect on a nearby microphone. Various alternate embodiments may be made. Tube, or sound path, 13 may enter through the back side of housing 11 but in FIG. 3 is shown as entering into housing 11 at opening. Also, alternatively, the device may be designed so that tube 13 runs within one or more of the circumferences of housings 8 and 11 and air baffle 4 and not outside their circumferences as shown. For ease of construction it probably would run outside diaphragm 5, However, ring 14 may be diverted, to accept tube 13 within what would otherwise be the circumference of diaphragm 5.

Figure 4:
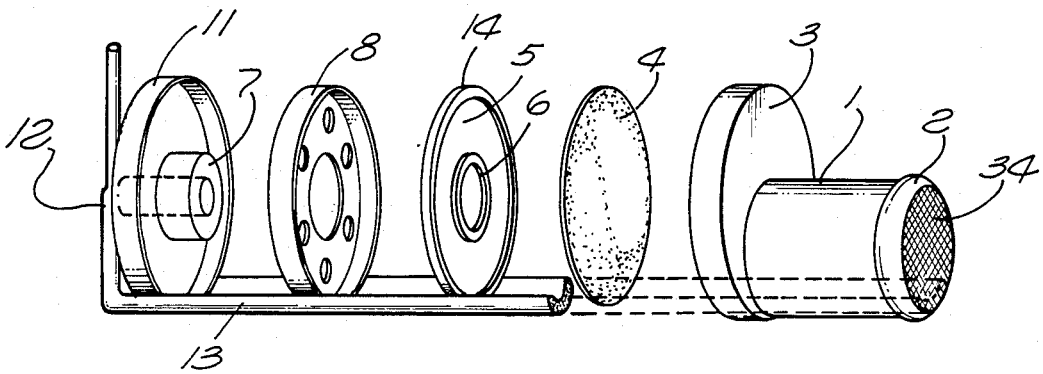
FIG. 4 is an exploded view showing the second sound path and the vent to the atmosphere both terminating in a central location at the back side of the diaphragm.

FIG. 4 shows the second sound path 13 entering the manifold from the back side, through magnet 7. Atmospheric vent tube 12 also enters the manifold from the back side through magnet 7. A desirable balance between the vent and the second sound path can be achieved by selection of relative tube inner diameter sizes, tube lengths, by the use of foam rubber, sintered metal, lamb's wool or other acoustic damping material to cover the tube openings or to be placed inside the tubes. Bass response can be improved by acoustic damping of the vent path to the atmosphere, or ambient air. It is noted that vent tube 12 is shown substantially smaller than tube 13, and that they both open up into a channel through magnet 7.

Figure 5:
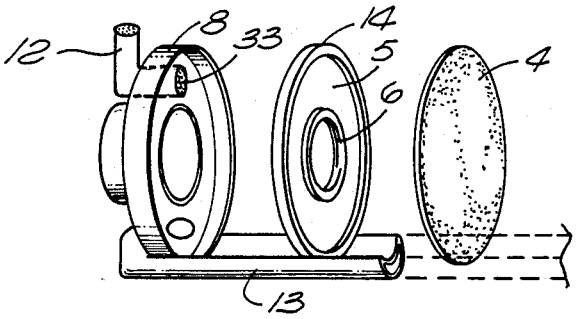
FIG. 5 is a simplified manifold, having a vent which terminates near one edge of the manifold and the second sound path entering the manifold from the back side.

In FIG. 5 is shown an embodiment in which there is no housing 11, but rather the sound path 13 enters from the back side of housing 8 and the manifold chamber it enters is formed between the diaphragm 5 and the housing 8. As in the other embodiments, acoustic damping may be provided in one or both of the tubes 12 or 13. Also, one conduit may be heavily damped and the other lightly damped. Preferably, the vent tube 12 to the atmosphere would be more heavily damped than the sound path 13.

Figure 6:
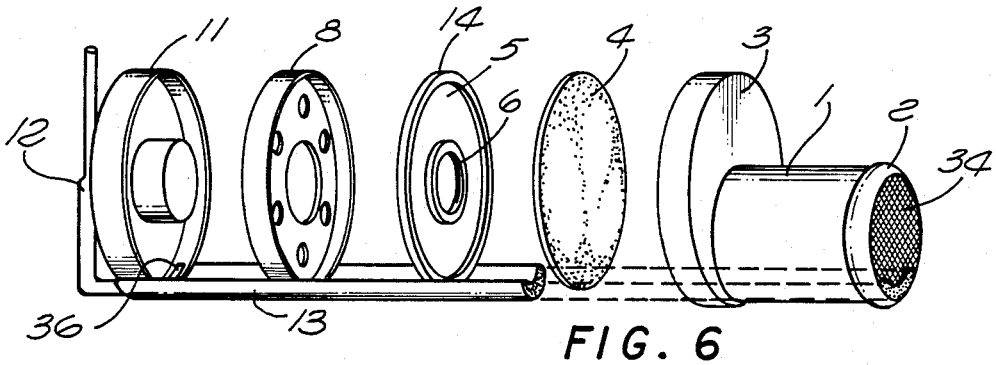
FIG. 6 shows the second sound path which runs to the manifold, merging with the vent to the atmosphere.

FIG. 6 illustrates a concept in which sound path 13 enters the manifold provided by housings 8 and 11, at opening 36 and sound path 13 is joined by the vent tube 12. In FIG. 6, the vent tube 12 is smaller than the sound path 13. Balance between venting and feedback to the manifold (or feed from the manifold outward) can be achieved by relative tube sizes or damping materials disposed within such tubes and at their openings.

Figure 7:
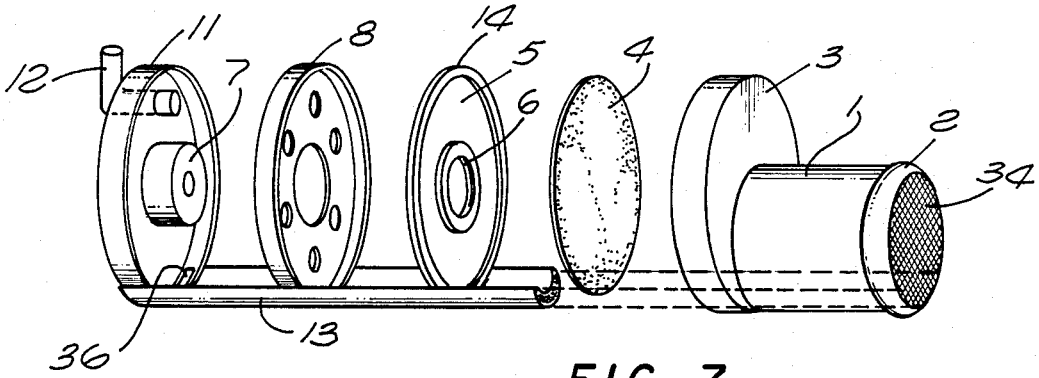
FIG. 7 shows a vent to the atmosphere, which vent commences in closer proximity to the diaphragm.

FIG. 7 illustrates a venting embodiment in which the vent tube 12 runs to the inside of housing 8. Additional venting, if desired, can be obtained through the center of magnet 7. Sound path 13 runs to the manifold, as before discussed.

Figure 8:
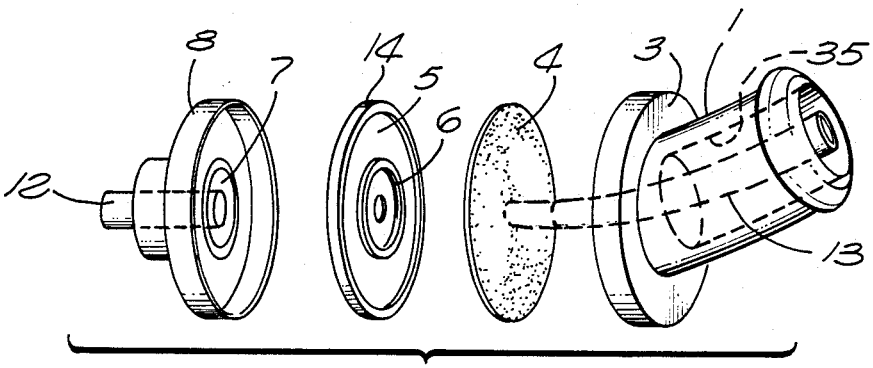
FIG. 8 shows an earmold which is angled and the second sound path runs from a central location in the earmold, through the center of the diaphragm, to its back side.

In FIG. 8 is shown an angled eartip which more closely resembles an actual shape of an eartip which has been molded to the ear. The sound path 13 is shown terminating (or beginning) centrally within the passageway in eartip 1. It passes centrally through air baffle 4 and passes through diaphragm 5 to the manifold between diaphragm 5 and housing 8. Diaphragm is mounted around sound path 13 so as to firmly hold it, yet be enabled to freely vibrate as required.

Figure 9:
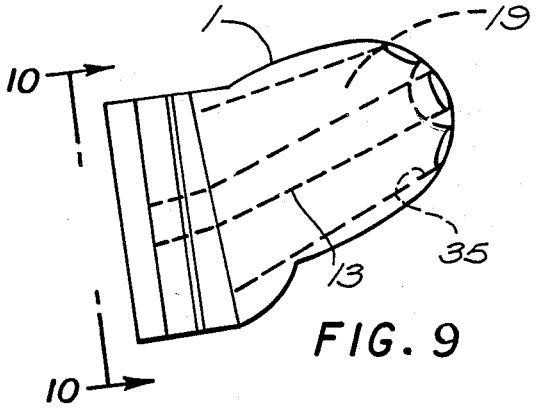
FIG. 9 shows a customized earmold, having a second sound path centrally located in a sound chamber.
Figure 11:
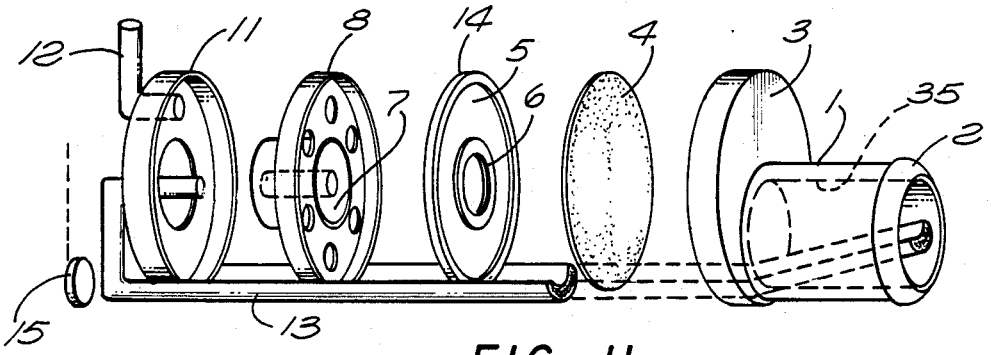
FIG. 11 is an exploded view showing the second sound path running to a central location at the back side of the diaphragm.

FIG. 9 shows an eartip 1 having a first sound path therein (shown by inner wall 35), and which eartip may have been molded (an earmold) to fit a specific person's ear. A sound chamber such as shown at 19 may be provided in eartip 1, so that air vibrations can pass readily to the ear with a pleasing sound. In FIG. 9, sound path 13 is shown running through the center of the sound chamber in eartip 1. It may be constructed, of course, to commence at the center of the end of eartip 1 and slope to the bottom of the eartip, as shown in FIG. 11.

As used in this specification and in the claims, "eartip" is intended to include an earmold, or any of the structures intended to transmit sound waves to, into or in the ear canal.

Figure 10:
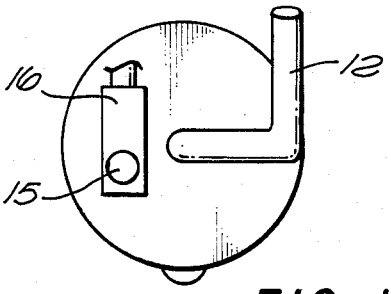
FIG. 10 is an external view of the earphone, showing a microphone, microelectronics and a vent to the atmosphere from a central location in the back side of the earphone.

FIG. 10. shows the outside appearance of the earphone. The view is a side view of FIG. 9, looking in the direction indicated by the line 10—10 of FIG. 9. The vent tube 12 is disposed so that it does not readily cause feedback to microphone 15 which is shown mounted on microcircuit 16. Any suitable miniature microphone may be used. One such suitable microphone that is commonly used is an electret or a condenser type microphone which is used in pressure zone microphones which are commonly available in retail radio and electronic stores. Most any of the microphones used in hearing aids would also be suitable. A particular feature of an earphone having a microphone is that it allows the earphone to have an eartip which is sealed in the ear (so that the hearer can listen to high fidelity music on a tape player or radio) and still hear outside sound. This is an important safety feature.

In FIG. 10 a battery is not shown, but one would, of course, be required in order to operate the microcircuit and, possibly, the microphone. If the earphone is connected to a radio or tape player, power may be drawn from that.

Figure 12:
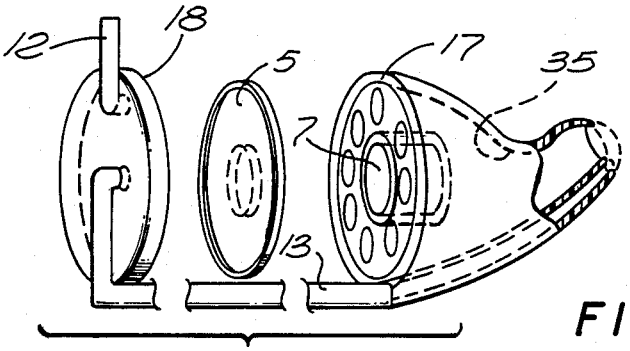
FIG. 12 is an exploded view in which the magnet and the diaphragm are reversed in relative location.

FIG. 11 illustrates the sound path 13 entering from the back side of the hearing aid and passing through magnet 7 into the manifold space between diaphragm 5 and housing 8. Vent tube 12 runs from the manifold between housings 8 and 11. Sound path 13 is shown angled upwardly within eartip 1. A microphone 15 may advantageously be disposed relative to the vent 12 as shown in FIG. 11. FIGS. 11 and 12 show the internal wall 35 of the sound path through eartip 1.

FIG. 12 is an embodiment in which the diaphragm and the magnet (together with its housing) are reversed. The eartip 1 which is partially broken away at its end is fixed to a housing 17 which holds magnet 7. Diaphragm 5 is mounted in or between housings 17 and 18. Sound path 13 runs from inside the eartip 1 to housing 18 and enters the manifold between housing 18 and diaphragm 5. Vent tube 12 vents such manifold to the atmosphere.

Figure 13:
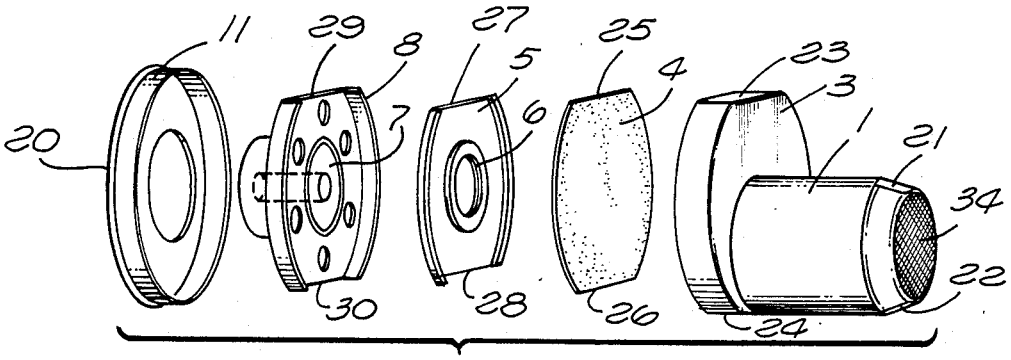
FIG. 13 is an exploded view showing the "looseness of fit concept" and feedback channels between the fit of the earphone and the structure of the ear.

FIG. 13 is an exploded view in which no feedback conduit 13 exists. The feedback is accomplished by a "looseness of fit" between the earphone and the structure of the ear. There is a seal 20 on housing 11. Such seal 20 does form a seal against the ear structure. In the structure shown, such seal would be at the external portion of the ear. If the hearing aid were made smaller in diameter, say, the size of the eartip 1, the seal 20 could act to seal in the auditory canal of the ear. In those cases in which "looseness of fit" feedback is desired to be enhanced, the earphone elements may be constructed to provide a channel between the earphone and the ear structure. As may be seen in FIG. 13, rib 2 is constructed with a flattened portions 21 and 22. Housing 3 has flattened portions 23 and 24. Baffle 4 has flattened portions 25 and 26. Diaphragm 5, likewise, has flattened portions 27 and 28, and housing 8 has flattened, or cut-away portions 29 and 30. Housing 11 does not have such flattened portions and the feedback sound is fed into the manifold between housing 11 and housing 8 through apertures formed by flattened portions 29 and 30. Of course, a single, flattened portion running along only one side of the earphone may be used as may two or more smaller flattened portions. Such flattened portions may be replaced by feedback channels which are concave in shape rather than flat.

It may be understood that all embodiments may utilize venting from inside the ear canal to the atmosphere, as is commonly known and used in the prior art. Such venting usually requires substantial acoustic damping. It may also be understood that venting may be run from the front side of the diaphragm to the atmosphere as well as from the back side of the diaphragm to the atmosphere, although venting from the back side provides better sound. For example, in FIG. 2, it is illustrated that holes (shown in dotted lines) 31 and 32 may be constructed in the wall of housing 11 (similar to those holes 9 and 10 in housing 8). Covering the holes so constructed, with an acoustic material, would provide a damped path to the atmosphere from the manifold formed by housing 8 and housing 11. In such case, vent 12 may or may not be utilized.

It is to be appreciated that dimensions of the earphone of the invention will vary with size of the person to which it is adapted. Nevertheless, the following dimensions will be helpful in arriving at a hearing aid which performs well. The sound channel (which conducts the sound) in the ear may well be ¼ of an inch in diameter. The second sound path, conduit 13, within that channel may be ⅛ of an inch, outer diameter, and 3/32 of an inch inner diameter. In such case, the wall of the conduit 13 would be 1/32 of an inch thick. The vent tube 12 will vary in size, but where the conduit 13 is 3/32" in inner diameter, the vent tube 12 may well be 1/32 of an inch or less. If the vent tube 12 is larger, it requires greater acoustic damping within it or by a covering, or by narrowing it at its exit. Frequency response at the higher frequencies improves if the conduit is not a soft plastic tube. However, a soft plastic tube, made of plastics such as polyethylene or silicone rubber, works well for general purposes. In some instances, the conduits may be channels formed, at least partially, in the hard plastic of the hearing aid. In those cases, the higher frequencies are transmitted more strongly.

Although specific embodiments and certain structural arrangements have been illustrated and described herein, it will be clear to those skilled in the art that various other modifications and embodiments may be made incorporating the spirit and scope of the underlying inventive concept and that the same is not limited to the particular forms herein shown and described except insofar as indicated by the scope of the appended claims.

I claim:

1. A method of providing sound to the ear, comprising, providing a first path to the ear canal for sound, and providing a second path to the ear canal for said sound approximately 180 degrees out of phase with the sound in said first path.

2. The method of claim 1 wherein said paths terminate in proximity to each other at their ends which provide sound to the ear.

3. The method of claim 2 further including the step of damping at least one of said paths.

4. The method of claim 3 further including the step of venting at least one of said paths to the atmosphere.

5. A method of providing sound to the ear comprising providing a first path from one surface of a diaphragm, which vibrates and causes variable air pressure, to the ear canal for sound, and providing a second path from inside the ear at approximately the termination of said first path to a location having the variable air pressure caused by the other surface of said diaphragm.

6. The method of claim 5 further including the step of damping at least one of said paths.

7. The method of claim 5 further including the step of providing a third path, for venting purposes, from one of said surfaces of said diaphragm to the atmosphere.

8. An earphone comprising a manifold comprising a chamber having at least first and second walls, a magnet fixed with respect to said manifold chamber, a coil of wire adapted to receive electrical signals representing sound and to provide a magnetic field in accordance with said sound, said coil of wire disposed near said magnet and adapted to magnetically interact with said magnet, a diaphragm having its periphery fixed in proximity to said first wall of said manifold chamber and said diaphragm being attached to said coil and adapted to be driven thereby to provide air vibrations, venting means for venting the pressures from said diaphragm to the atmosphere, said first wall of said manifold chamber in proximity to said diaphragm having at least one hole therethrough wherein said diaphragm provides air vibrations through said holes into said chamber of said manifold, an eartip comprising a first conduit therein adapted to receive said air vibrations on one end and the other end of said eartip adapted to fit into the ear, a second conduit running from a location near said other end of said eartip, to said manifold chamber.

9. An earphone as recited in claim 8 wherein said location is at the end of said eartip adapted to fit into the ear.

10. An earphone as recited in claim 8 wherein said second conduit extends past said diaphragm at its periphery.

11. An earphone as recited in claim 8 wherein said venting means includes damping means.

12. An earphone as recited in claim 8, further including an air baffle between said diaphragm and said eartip, and wherein said air baffle and said diaphragm form a sound chamber.

13. An earphone as recited in claim 8 wherein said venting means comprises a conduit which runs through the center of said magnet to the atmosphere.

14. An earphone as recited in claim 8 wherein said venting means runs from said manifold chamber to the atmosphere.

15. An earphone as recited in claim 8 wherein said magnet is fixedly attached to said first wall of said manifold chamber.

16. An earphone as recited in claim 8 wherein said magnet is fixedly attached to said second wall of said manifold chamber.

17. An earphone comprising a manifold having a chamber having at least two walls, a magnet fixed with respect to at least one wall of said manifold chamber, a coil of wire adapted to receive electrical signals representing sound and to provide a magnetic field in accordance with said sound, said coil of wire disposed so that said magnetic field magnetically interacts with said magnet, a diaphragm having first and second sides, and having its periphery fixed with respect to one of the walls of said manifold chamber and said diaphragm being attached to said coil and adapted to be vibrated thereby, providing an output of sound on its first side, the wall of said manifold chamber near said second side of said diaphragm having a plurality of holes therethrough, an air baffle next to said diaphragm, on the first side of said diaphragm, an eartip having a first conduit therethrough, said first conduit adapted to receive the output through said air baffle on one side of said eartip which is adapted to fit into the ear on the other side and a second conduit disposed to run from a location approximately at the end of said eartip adapted to fit into the ear, to said manifold chamber.

18. An earphone as recited in claim 17 wherein said second conduit extends past said diaphragm and said baffle at their peripheries.

19. An earphone as recited in claim 17 wherein said second conduit begins at the end of said eartip where it fits into the ear.

20. An earphone as recited in claim 17 further including a third conduit, for venting purposes, from one side of said diaphragm to the atmosphere, and means for acoustically damping the sound in said third conduit by at least one of, its length, its size, acoustic damping material covering said conduit and acoustic damping material within said conduit.

21. An earphone having a diaphragm, said diaphragm having a front side and a back side, and an eartip which fits inside the ear and which eartip has two conduits therein; one of said conduits being adapted to receive the output from the front side of said diaphragm and transmit it to the end of said eartip which fits inside the ear, a manifold chamber on the back side of said diaphragm, the other of said conduits running from a location near the end of said eartip, which fits inside the ear, to said manifold chamber.

22. An earphone as recited in claim 21, wherein said location is at the end of said eartip inside the ear.

23. An earphone as recited in claim 21, wherein venting conduit means is included, venting the back side of said diaphragm to the atmosphere.

24. An earphone comprising a diaphragm adapted to be vibrated in accordance with sound, a first conduit for delivery of sound vibrations to the ear, one surface of said diaphragm disposed to deliver sound vibrations to an ear canal through said first conduit, a second conduit, running from a location in close proximity to where sound is delivered by said first conduit, to the other surface of said diaphragm.

25. An earphone as recited in claim 24, wherein said second conduit has damping means associated therewith to reduce the flow of air through said second conduit.

26. An eraphone as recited in claim 25, wherein said damping means comprises at least one of the structural elements of said conduit, said elements comprising the resilience of the inner walls of such conduit, the conduit length or the conduit size.

27. An earphone comprised of a diaphragm having front and back sides, first and second conduit means, one end of said first conduit means disposed to connect said front side of said diaphragm to a location for delivery of sound in the ear canal of a wearer of the earphone and one end of said second conduit means disposed to connect said back side of said diaphragm to approximately said same location.

28. An earphone as recited in claim 27 wherein said second conduit means connects said back side of said diaphragm to the same location said first conduit means delivers sound.

29. An earphone as recited in claim 27 further including means for venting to the atmosphere at least one of the back side of said diaphragm or said conduit means.

30. An earphone as recited in claim 29 wherein said means for venting comprises acoustic damping means.

31. An earphone comprising an eartip having a first path therethrough for providing sound to the ear canal, a second path for providing sound to the ear canal for sound approximately 180 degrees out of phase with the sound in said first path, said first and second paths terminating at approximately the same location at their ends providing said sound.

32. An earphone as recited in claim 31 wherein means for damping the sound in one or both of said paths is included.

33. An earphone as recited in claim 31 wherein said second path is provided at least partially by a channel between the ear canal and said eartip.

34. An earphone as recited in claim 33 wherein said eartip comprises at least one of a flat surface and a channel running along the outside of said earphone to a location at the back side of said diaphragm.

35. An earphone as recited in claim 31 wherein said second path is provided at least in part by space between the circumference of said eartip and the ear canal when said eartip is disposed in an ear canal.

36. An earphone comprising a manifold comprising a chamber, a diaphragm disposed in fixed proximity to said chamber and adapted produce sound vibrations of air in said chamber from one side of said diaphragm, an eartip in fixed proximity to said diaphragm, a first sound conduit extending from the other side of said diaphragm through said eartip and a second sound conduit extending from said chamber to a location near the end of said first sound conduit.

* * * * *